United States Patent [19]

Dürrnagel et al.

[11] Patent Number: 4,534,289

[45] Date of Patent: Aug. 13, 1985

[54] COOLING ROLLER WITH DIFFERENT PRESELECTED COOLING ZONES

[75] Inventors: Klaus Dürrnagel, Eppelheim; Willi Jeschke, Heidelberg; Hans-Georg Jahn, Wiesenbach, all of Fed. Rep. of Germany

[73] Assignee: Heidelberger Druckmaschinen AG, Heidelberg, Fed. Rep. of Germany

[21] Appl. No.: 551,099

[22] Filed: Nov. 14, 1983

[30] Foreign Application Priority Data

Nov. 13, 1982 [DE] Fed. Rep. of Germany ..... 3242066

[51] Int. Cl.[3] ..... B21B 27/06; B41F 31/26; F28D 11/02

[52] U.S. Cl. ..... 101/348

[58] Field of Search ..... 101/348, 349, 350, 364, 101/416 A, 416 R, 216, 219; 34/124, 109, 133, 139, 63; 165/89, 90

[56] References Cited

U.S. PATENT DOCUMENTS

| | | | |
|---|---|---|---|
| 2,870,546 | 1/1959 | Nelson et al. | 34/124 |
| 2,893,136 | 7/1959 | Justus et al. | 34/124 X |
| 3,065,552 | 11/1962 | Skinner | 34/124 |
| 3,914,875 | 10/1975 | Schiel | 34/124 X |
| 4,183,298 | 1/1980 | Cappel | 34/124 X |

FOREIGN PATENT DOCUMENTS

| | | | |
|---|---|---|---|
| 2658380 | 6/1978 | Fed. Rep. of Germany | 101/348 |

*Primary Examiner*—J. Reed Fisher

*Attorney, Agent, or Firm*—Herbert L. Lerner; Laurence A. Greenberg

[57] ABSTRACT

Printing-press roller traversed by a temperature-regulating medium and having jacket-like partitions in the interior thereof surrounded by an outer circumferential wall, includes at least one heat-insulating element disposed in a middle region of the circumferential roller wall, the element forming an impediment to a transfer of heat on the surface of the circumferential roller wall in longitudinal direction thereof.

8 Claims, 2 Drawing Figures

COOLING ROLLER WITH DIFFERENT PRESELECTED COOLING ZONES

Figure 1:
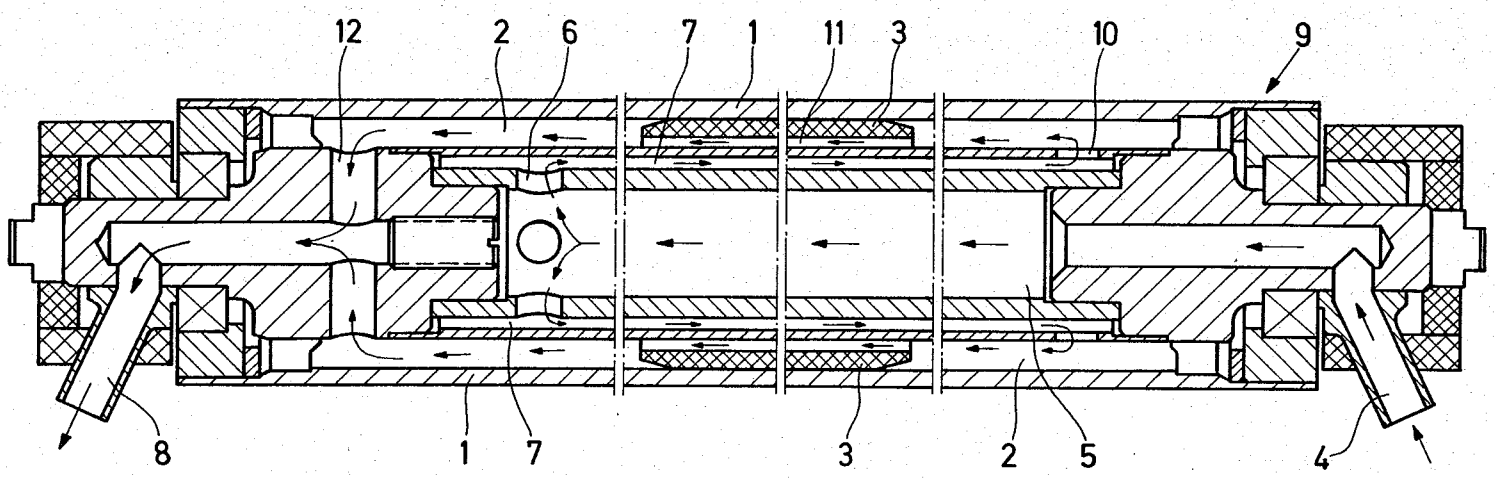

The invention relates to a cooling roller with different preselected cooling zones and, more particularly, to such a cooling roller for printing machines which is traversed by a heating or heat-regulating medium and which is provided with jacket-like partitions in the interior thereof.

The cooling and temperature-regulation of rollers, such as ink rollers in inking units, especially, has become known heretofore, for example, from German Published Prosecuted Application (DE-AS) No. 26 58 380.

In order to keep the ink temperature largely constant when there is an interruption in the operation of the printing machine and in order to minimize the temperature difference of the ink film over the length of the roller, a displacement body is disposed in the interior of the ink roller, and that part of the cross section of the ink roller remaining free is subdivided by a jacket-like partition having good thermal conductivity into two concentric annular gaps or passages which are traversed by the temperature regulating medium in a counter-current flow at a high flow rate.

The rollers of a printing unit in printing machines are subject to heating during the operation of the printing machine, the degree of heating increasing with the printing speed.

The heat development arising due to friction of the individual cylinders, distributor rollers and rubber-covered or blanket rollers has a disadvantageous or detrimental effect upon the printed products. This heating which results from bearing friction, rolling of gearwheels and other moving parts in vicinity of the lateral walls of the printing machine effects undesired scumming at the high-contrast locations of printed sheets. The heating occurs especially intensified at both ends of the roller.

It is further disadvantageous that the discharge of the temperature-regulating medium occurs at the same end of the roller as that at which the inlet is concentrically surrounded by a return flow thereof, because heating of the temperature-regulating medium thereby occurs even before actual cooling of the roller.

It is accordingly an object of the invention to provided a roller of the aforementioned type whereon the ink temperature remains virtually constant during interruptions in the operation of the printing machine and no temperature gradient of the ink film is established over the length of the roller.

With the foregoing and other objects in view, there is provided, in accordance with the invention, a printing-press roller traversed by a temperature-regulating medium and having jacket-like partitions in the interior thereof surrounded by an outer circumferential wall, includes at least one heat-insulating element disposed in a middle region of the circumferential roller wall, the element forming an impediment to a transfer of heat on the surface of the circumferential roller wall in longitudinal direction thereof.

In accordance with another feature of the invention, the outer circumferential wall and one of the jacket-like partitions define an outer cooling chamber region wherein the heat-insulating element is concentrically received.

In accordance with an alternative feature of the invention, there is provided, in accordance with the invention, a printing-press roller traversed by a temperature-regulating medium and having jacket-like partitions in the interior thereof surrounded by an outer circumferential wall, includes at least one heat-insulating element incorporated substantially at the middle of and flushly into the surface of the circumferential roller wall.

In accordance with a further feature of the invention, respective flanges close off the interior of the roller at opposite ends of the outer cylindrical wall thereof, respective pipelines being located at the flanges and terminating in the interior of the roller for introducing into and discharging from the roller interior the temperature regulating medium in order to counteract increased heating at both ends of the roller.

In accordance with an added feature of the invention, there is provided at least one inlet nozzle to the interior of the roller located at a drive end of the roller for introducing the temperature-regulating medium into the interior of the roller with maximum heating at the drive end thereof. Due to the fact that the inlet of the temperature-regulating medium is at the drive end of the roller, the end of the roller which is subject to greater heating is rinsed or bathed first by the temperature-regulating or cooling medium.

In accordance with an additional feature of the invention, the temperature-regulating medium is fed through an inner cooling chamber region, then through a middle cooling chamber region and, thereafter, through the outer cooling chamber region below the concentrically disposed heat-insulating element formed of a tube or pipe section to the pipeline or nozzle provided for discharging the medium. Abrupt differences in temperature can no longer occur at the surface of the cooling roller due to this additional heat insulation.

Other features which are considered as characteristic for the invention are set forth in the appended claims.

Although the invention is illustrated and described herein as embodied in cooling roller with different preselected cooling zones, it is nevertheless not intended to be limited to the details shown, since various modifications and structural changes may be made therein without departing from the spirit of the invention and within the scope and range of equivalents of the claims.

Figure 2:
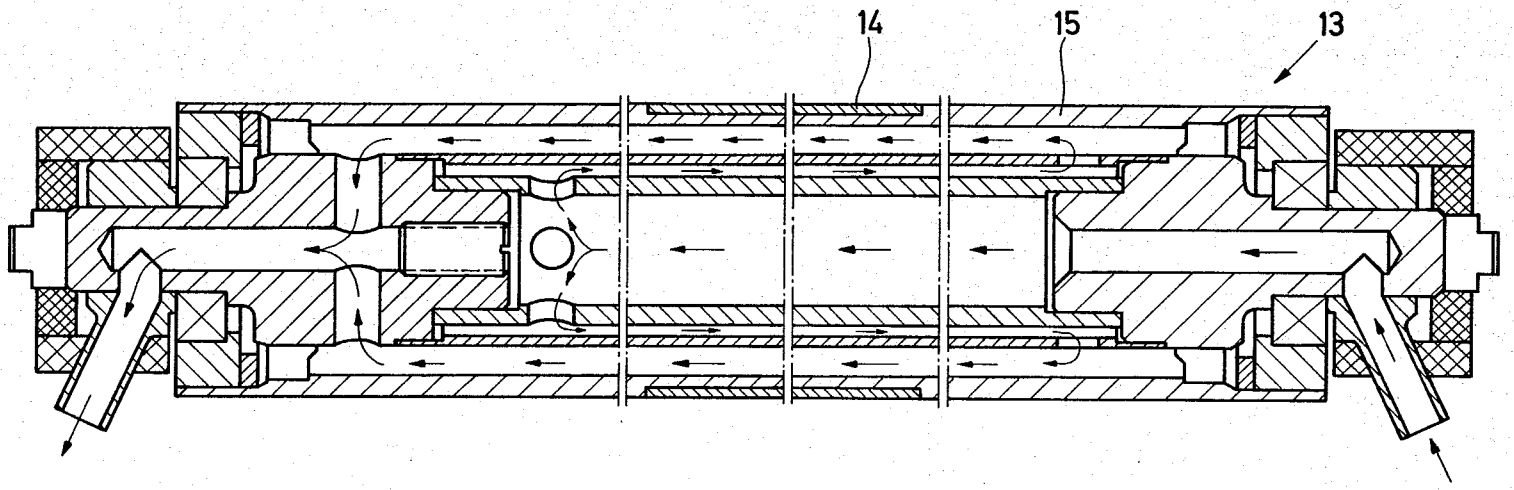

The construction and method of operation of the invention, however, together with additional objects and advantages thereof will be best understood from the following description of specific embodiments when read in connection with the accompanying drawings, in which:

FIGS. 1 and 2 are longitudinal sectional views of two different embodiments of the cooling roller with different preselected cooling zones according to the invention.

Referring now to the drawing and first, particularly, to FIG. 1 thereof, there is shown an ink roller 9 formed so as to provide interior counterflow heat exchange.

Coolant flows through an inlet pipe or nozzle 4 into an inner cooling chamber region 5 and enters through bores 6 into a middle cooling chamber region 7. The coolant flows through the middle cooling chamber region 7 in opposite direction to that of the flow through the inner cooling chamber region 5. At the end of the middle cooling chamber region 7, the coolant passes through openings 10 into an outer cooling chamber 2 defined in part by the outer casing or cylindrical wall of the ink roller 1, a heat-insulating element 3 being located at the inner surface and substantially at the middle of the outer casing or cylindrical wall of the roller 1.

The coolant then flows again in the same direction as in the inner cooling chamber region 5 or, in other words, in opposite direction so that of the flow through the middle cooling chamber region 7. A cross-sectional constriction 11 is formed by the heat-insulating element 3 in the outer cooling chamber region 2, the constriction 11 causing an increase in flow rate or speed and a decrease in pressure in flow direction of the coolant. After the coolant. After the coolant has passed the cross-sectional constriction 11 of the outer cooling channel region 2, the speed of the coolant flow decreases, and a simultaneous increase in the pressure of the coolant occurs in the direction of flow. At the end of the outer coolant chamber region 2, the coolant or temperature-regulating medium flows through outlet bores 12 and out through a discharge pipe or nozzle 8.

In FIG. 2 there is also shown an ink roller 9 with internal counterflow heat exchange. The inlet or feed and the outlet or discharge systems of the embodiment of FIG. 2 are of the same type as those of the embodiment of FIG. 1. A heat-insulating element 14, however, is not located in the outer cooling chamber region, but rather, is incorporated into the outer jacket or cylindrical wall 15 of the cooling roller substantially at the middle thereof and has an insulating effect. As is readily apparent, the outer cylindrical wall 15 is suitably undercut so that the tube-like section of which the heat-insulating element 14 is formed fits flush therein.

As mentioned hereinbefore, the illustrated and hereinafore-described embodiments of the invention in no way represent the sole possibilities of realizing the invention. It is conceivable, for example, to dispose the heat-insulating element on the outer wall surface of the roller i.e. with undercutting, in order to achieve the same effect.

The foregoing is a description corresponding, in substance, to German application No. P 32 42 066.8, dated Nov. 13, 1982, the International Priority of which is being claimed for the instant application, and which is hereby made part of this application. Any material discrepancies between the foregoing specification and the specification of the aforementioned corresponding German application are to be resolved in favor of the latter.

There are claimed:

1. Printing-Press roller traversed by a temperature-regulating medium and having jacket-like partitions in the interior thereof surrounded by an outer circumferential wall, comprising means located at one axial end of the outer circumferential wall for introducing the temperature regulating medium into the interior of the roller, means for conducting the temperature-regulating medium in a circuitous path through the interior of the roller, means located at the other axial end of the outer circumferential wall for discharging the temperature-regulating medium from the interior of the roller; and at least one heat-insulating element disposed in a middle region of the circumferential roller wall, said element forming an impediment to a transfer of heat on the surface of the circumferential roller wall in longitudinal direction thereof.

2. Roller according to claim 1 wherein the outer circumferential wall and one of the jacket-like partitions define an outer cooling chamber region wherein said heat-insulating element is concentrically received.

3. Printing-press roller traversed by a temperature-regulating medium and having jacket-like partitions in the interior thereof surrounded by an outer circumferential wall, comprising means located at one axial end of the outer circumferential wall for introducing the temperature regulating medium into the interior of the roller, means for conducting the temperature-regulating medium in a circuitous path through the interior of the roller, means located at the other axial end of the outer circumferential wall for discharging the temperature-regulating medium from the interior of the roller; and at least one heat-insulating element incorporated substantially at the middle of and flushly into the surface of the circumferential roller wall.

4. Roller according to claim 1 including respective flanges closing off the interior of the roller at opposite ends of the outer cylindrical wall thereof, and said medium-introducing means and said medium-discharging means comprising at least one pipeline terminating in the interior of the roller and connectible to a tank containing the temperature-regulating medium under pressure.

5. Roller according to claim 1 wherein said medium-introducing means comprise at least one inlet nozzle to the interior of the roller located at a drive end of the roller for introducing the temperature-regulating medium into the interior of the roller with maximum heating at said drive end thereof.

6. Roller according to claim 1 wherein said heat-insulating element is located in a cooling chamber region within the interior of the roller for restricting flow of the temperature-regulating medium through said cooling chamber region.

7. Roller according to claim 1 wherein said medium-discharging means comprise at least one outlet nozzle from the interior of the roller located at an operator end of the roller for discharging the temperature-regulating medium from the interior of the roller.

8. Roller according to claim 1 wherein said heat-insulating element is a tube section disposed substantially at the middle of said outer cylindrical wall, flow of the heat-regulating medium past said tube section serving to distribute uniform temperature over the surface of the roller.

* * * * *